US011721916B2

(12) United States Patent
Watanabe et al.

(10) Patent No.: US 11,721,916 B2
(45) Date of Patent: Aug. 8, 2023

(54) CONNECTION STRUCTURE OF BUS BAR AND CABLE

(71) Applicant: Yazaki Corporation, Tokyo (JP)

(72) Inventors: Kazuma Watanabe, Shizuoka (JP); Hideki Mizuno, Shizuoka (JP); Yasuhiro Yamaguchi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/590,925

(22) Filed: Feb. 2, 2022

(65) Prior Publication Data

US 2022/0247098 A1 Aug. 4, 2022

(30) Foreign Application Priority Data

Feb. 3, 2021 (JP) ..... 2021-015542

(51) Int. Cl.
*H01R 4/02* (2006.01)
*H01R 4/70* (2006.01)

(52) U.S. Cl.
CPC ..... *H01R 4/70* (2013.01); *H01R 4/023* (2013.01)

(58) Field of Classification Search
CPC . H01R 4/023; H01R 4/70; H01R 4/62; H01R 43/16
See application file for complete search history.

(56) References Cited

U.S. PATENT DOCUMENTS 5,635,675 A * 6/1997 Houga ..... H02G 9/06 138/120
2011/0198122 A1 8/2011 Sagawa et al.
2013/0252488 A1 9/2013 Ito et al.
2020/0112109 A1 4/2020 Izawa et al.

FOREIGN PATENT DOCUMENTS

| | | | |
|---|---|---|---|
| DE | 102006062850 | * | 3/2013 |
| EP | 3 579 341 A1 | | 12/2019 |
| JP | 8-227738 A | | 9/1996 |
| JP | 2013-196832 A | | 9/2013 |
| JP | 2017-120709 | * | 7/2017 |
| JP | 2019-016535 A | | 1/2019 |
| WO | 2017/115710 A1 | | 7/2017 |
| WO | 2018/116805 A1 | | 6/2018 |
| WO | 2021/002222 A1 | | 1/2021 |

* cited by examiner

*Primary Examiner* — Chau N Nguyen
(74) *Attorney, Agent, or Firm* — Sughrue Mion, PLLC

(57) ABSTRACT

A connection structure of a bus bar and a cable has: a bus bar that serves as an external terminal; a cable that has a core wire exposed from an insulation sheath at a terminal, the core wire being joined with the bus bar; a protective member that covers at least a joining portion of the bus bar and the core wire of the cable; and a cut portion that is formed in the core wire at the joining portion with the bus bar.

7 Claims, 2 Drawing Sheets

CONNECTION STRUCTURE OF BUS BAR AND CABLE

CROSS-REFERENCE TO RELATED APPLICATIONS

The present application is based on, and claims priority from Japanese Patent Application No. 2021-015542, filed on Feb. 3, 2021, the entire contents of which are incorporated herein by reference.

TECHNICAL FIELD

The present disclosure relates to a connection structure of a bus bar and a cable for joining and connecting a bus bar that functions as a terminal for external connection (an external terminal) and a core wire of a cable (a conductor).

BACKGROUND

JP H8-227738 A discloses a connection structure of a bus bar and a cable, in which a core wire exposed from a terminal of a cable is connected and welded by means of ultrasonic welding or the like to an external terminal portion formed of a horizontal flat portion that is formed at a part of a bus bar.

SUMMARY

However, in the connection structure of the bus bar and the cable described above, suppose that a joining portion of the external terminal portion of the bus bar and the core wire of the cable is protected by covering the joining portion with an insulating cylindrical protective member. In the above case, since the bus bar and the core wire are connected in a stepped state, a space that has no use is formed and the entire structure is increased in size.

An object of the present disclosure is to provide a connection structure of a bus bar and a cable capable of reducing a space that is formed when a bus bar and a core wire of a cable are joined, and reducing the size of the whole structure.

A connection structure of a bus bar and a cable according to an embodiment includes: a bus bar that serves as an external terminal; a cable that includes a core wire exposed from an insulation sheath at a terminal, the core wire being joined with the bus bar; a protective member that covers at least a joining portion of the bus bar and the core wire of the cable; and a cut portion that is formed in the core wire at the joining portion with the bus bar.

The cut portion may be obtained by cutting the joining portion with the bus bar at a joining direction side of the core wire.

A joining surface of the cut portion that is joined with the bus bar may be formed to be a flat surface.

The bus bar and the core wire of the cable are joined by means of ultrasonic welding, and a joining portion of the bus bar and the core wire of the cable may be covered with the insulating cylindrical protective member.

According to the above configuration, it is possible to provide a connection structure of a bus bar and a cable capable of reducing a space that is formed when a bus bar and a core wire of a cable are joined, and reducing the size of the whole structure.

DETAILED DESCRIPTION

Hereinafter, a connection structure of a bus bar and a cable according to an embodiment of the present disclosure will be described in detail with reference to the drawings.

Figure 1:
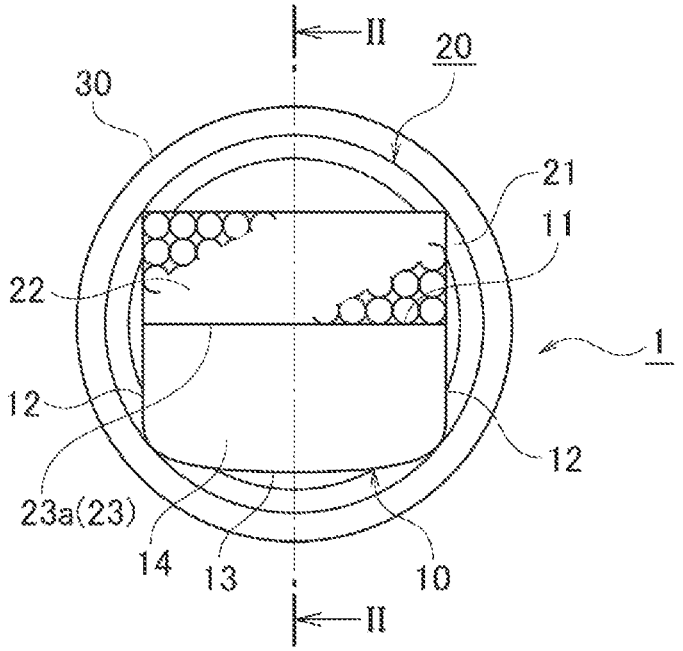
FIG. 1 is a front view showing an example of a connection structure of a bus bar and a cable according to an embodiment.
Figure 2:
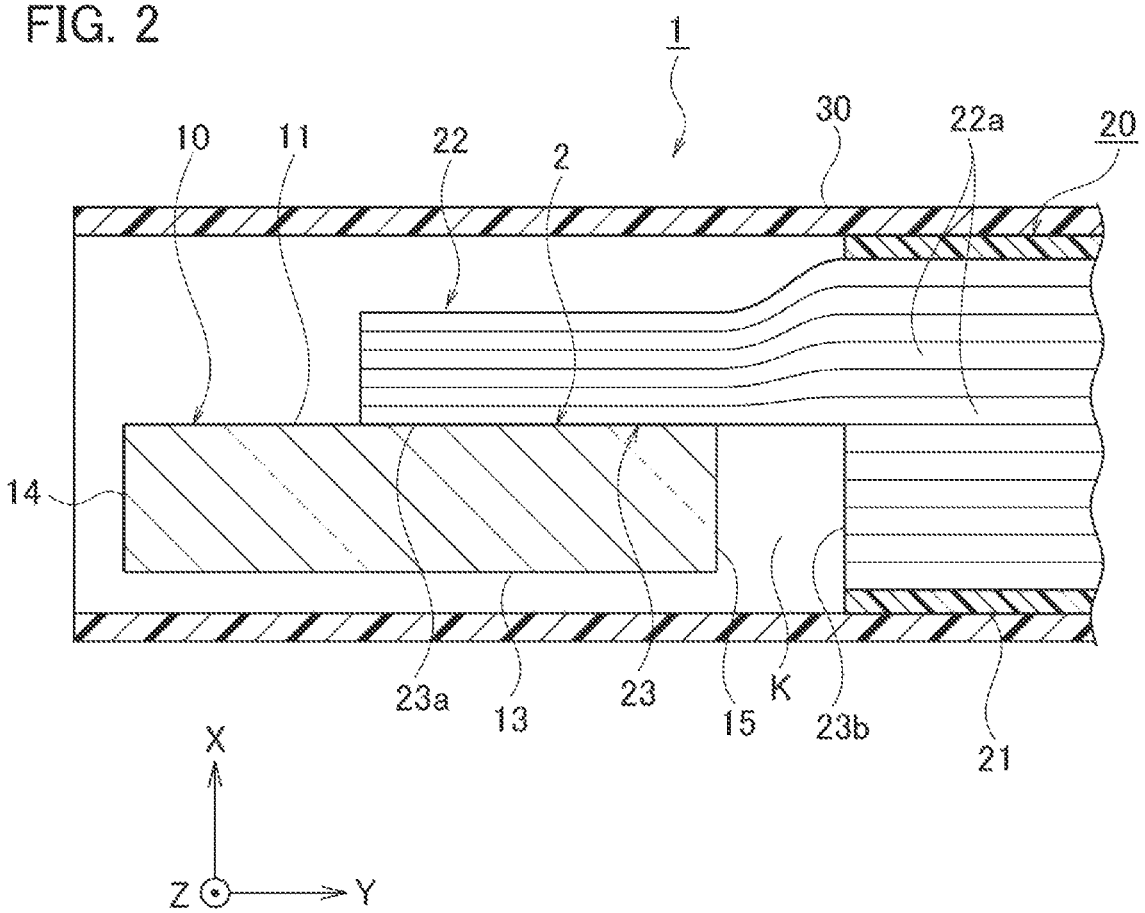
FIG. 2 is a cross-sectional view taken along line II-II in FIG. 1.

As shown in FIGS. 1 and 2, a connection structure 1 of a bus bar and a cable includes: a bus bar 10 that serves as an external terminal; a cable 20 that has a core wire 22 exposed from an insulation sheath 21 at a terminal, the core wire 22 being joined with the bus bar 10; and a protective member 30 that covers a joining portion of the bus bar 10 and the core wire 22.

The bus bar 10 is formed by punching a conductive metal plate and functions as a terminal for external connection (an external terminal). A top surface 11 of the bus bar 10 is formed to be a flat surface, and is a joining surface with the core wire 22 of the cable 20. Both side surfaces 12 and 12 of the bus bar 10 are formed to be flat surfaces and are perpendicular to the top surface 11. A bottom surface 13 is formed to be a curved surface that protrudes downward in an arc shape. A front surface 14 and a rear surface 15 of the bus bar 10 are also formed to be flat surfaces and are perpendicular to both side surfaces 12 and 12. The bottom surface 13 may be formed to be a flat surface that is parallel to the top surface 11.

Figure 3:
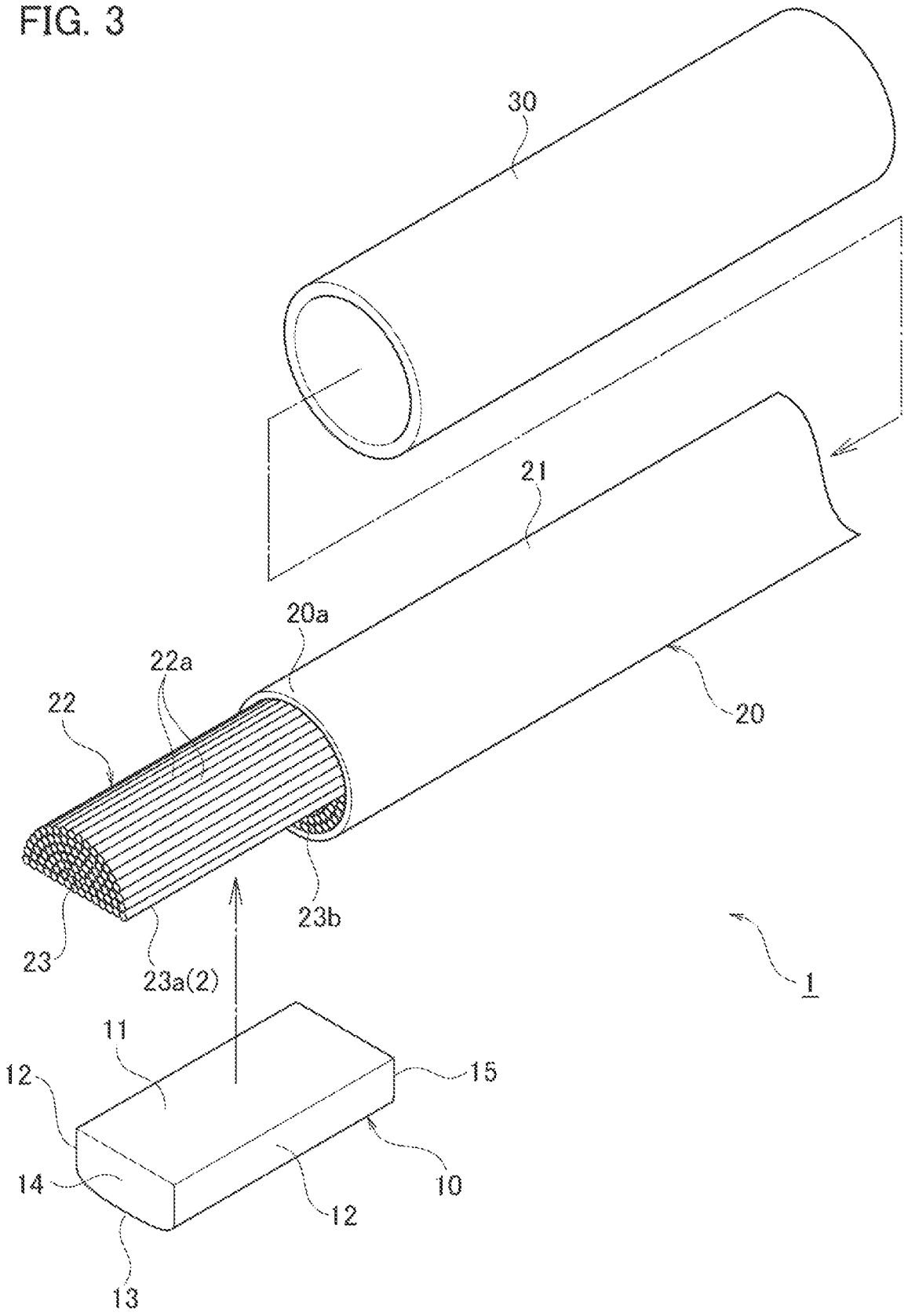
FIG. 3 is an exploded perspective view showing a state in which a bus bar and a cable of a connection structure are not yet joined.

As shown in FIG. 3, the end 20*a* of the cable 20 is formed by peeling off the insulation sheath 21 at a terminal of the cable 20, and the core wire 22 is exposed. The core wire 22 is a conductor formed of a plurality of element wires 22*a*, and is formed of a conductive material such as copper or a copper alloy, or aluminum or an aluminum alloy.

The core wire 22 of the cable 20 has a cut portion 23 at a joining portion 2 with the bus bar 10. The cut portion 23 is formed by cutting the joining portion with the bus bar 10 on the joining direction side (the side facing the bus bar 10 when being joined with the bus bar 10 in FIG. 2). By forming the cut portion 23 of the core wire 22 of the cable 20, the thickness (height) of the core wire 22 in the joining direction is reduced. A joining surface 23*a* of the cut portion 23 that is joined with the bus bar 10 is formed to be a flat surface. The bus bar 10 and the core wire 22 of the cable 20 are joined as shown in FIG. 2 by means of ultrasonic welding. At the time of joining by means of ultrasonic welding, as shown in FIGS. 1 and 2, the core wire 22 of the joining portion 2 is compressed into a square columnar shape having substantially the same width as the top surface 11 of the bus bar 10 and is joined with the bus bar 10. Further, the structure has at least a partially closed space K which is a gap in the joining direction between the core wire 22 or the cut portion 23, and the protective member 30. The space K is also a gap in the axial direction between the rear surface 15 of the bus bar 10 joined with the joining surface 23*a* of the cut portion 23 and a vertical surface 23*b* of the cut portion 23. In FIG. 2, reference character X denotes the joining direction (vertical direction), reference character Y denotes the axial direction (horizontal direction) of the core wire 22, and reference character Z denotes the longitudinal direction (width direction).

The protective member 30 is formed in a hard cylindrical form by using an insulating synthetic resin. The protective member 30 covers the bus bar 10 and the cable 20 from at least the front surface 14 which is the end of the bus bar 10 in the axial direction, to the end 20*a* of the cable 20. The protective member 30 covers the bus bar 10 and the exposed core wire 22 of the cable 20 in the axial direction and the circumferential direction of the cable 20. Accordingly, the protective member 30 functions as a connector housing. The sealing property in the protective member 30 can be enhanced by interposing an annular waterproof plug made of rubber between the protective member 20 and the end 20*a* of the cable 20.

As described above, according to the connection structure 1 of the bus bar and the cable of an embodiment, as shown in FIG. 2, the bus bar 10 connected to the core wire 22 of the cable 20 fits in the cut portion 23 of the core wire 22 in the joining direction. Therefore, the thickness of the connection structure 1 in the joining direction (vertical direction) can be suppressed. This can reduce a space K which is a gap in the joining direction between the core wire 22 or the cut portion 23, and the cylindrical protective member 30 and is also a gap in the axial direction between the rear surface 15 of the bus bar 10 joined with the joining surface 23*a* of the cut portion 23 and the vertical surface 23*b* of the cut portion 23. Accordingly, the whole connection structure 1 of the bus bar 10 and the cable 20 can be reduced in size.

Further, in the core wire 22, the joining portion with the bus bar 10 is cut in the joining direction (vertical direction) to obtain the cut portion 23, and the joining surface 23*a* of the cut portion 23 with the bus bar is formed to be a flat surface. Accordingly, when the core wire 22 of the cable 20 and the bus bar 10 are joined by means of ultrasonic welding, joining can be performed easily.

Although the present embodiment has been described above, the present embodiment is not limited to the above description, and various modifications can be made within the scope of the gist of the present embodiment.

That is, according to the embodiment, a bus bar and a core wire of a cable are joined by means of ultrasonic welding. However, alternatively a bus bar and a core wire of a cable may be joined by means of electric resistance welding or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connection structure of a bus bar and a cable comprising:

a bus bar that serves as an external terminal;

a cable that includes a core wire exposed from an insulation sheath at a terminal, the core wire being joined with the bus bar;

a protective member that covers at least a joining portion of the bus bar and the core wire of the cable; and a cut portion that is formed in the core wire at the joining portion with the bus bar, wherein the cut portion has a joining surface formed by cutting a joining direction side of the joining portion with the bus bar and a vertical surface formed to be perpendicular to the joining surface, the connection structure of the bus bar and the cable further comprises a gap formed between the vertical surface and a rear surface of the bus bar facing to the vertical surface, and the protective member covers the bus bar and the cable from at least a front surface of the bus bar in an axial direction to the joining portion.

2. The connection structure of the bus bar and the cable according to claim 1, wherein the cut portion is obtained by cutting the joining portion with the bus bar at the joining direction side of the core wire.

3. The connection structure of the bus bar and the cable according to claim 1, wherein the joining surface of the cut portion that is joined with the bus bar is formed to be a flat surface.

4. The connection structure of the bus bar and the cable according to claim 1, wherein the bus bar and the core wire of the cable are joined by means of ultrasonic welding; and the protective member has an insulating property and a cylindrical shape.

5. The connection structure of the bus bar and the cable according to claim 1, wherein the protective member has a cylindrical shape.

6. The connection structure of the bus bar and the cable according to claim 1, wherein the protective member is formed in a hard cylindrical form.

7. The connection structure of the bus bar and the cable according to claim 1, wherein the protective member is configured to function as a connector housing.

* * * * *